US005713226A

United States Patent [19]

Yu

[11] Patent Number: 5,713,226

[45] Date of Patent: Feb. 3, 1998

[54] LUGGAGE LOCK

[76] Inventor: Chen Te Yu, No. 255, Sec. 3, Yanhae Road, Shiahnian Village, Fushin Shian, Janghuah, Taiwan

[21] Appl. No.: 806,169

[22] Filed: Feb. 26, 1997

[51] Int. Cl.[6] ..... E05B 65/52

[52] U.S. Cl. ..... 70/69; 70/70; 70/71; 70/74; 70/312

[58] Field of Search ..... 70/3–5, 18, 30, 70/67–75, 301, 304, 312

[56] References Cited

U.S. PATENT DOCUMENTS

| | | | |
|---|---|---|---|
| 3,100,980 | 8/1963 | Humphries | 70/71 |
| 3,270,535 | 9/1966 | Fukuroi | 70/68 |
| 4,031,724 | 6/1977 | Atkinson | 70/75 X |
| 4,951,485 | 8/1990 | Wake | 70/68 |
| 5,117,663 | 6/1992 | Ida | 70/71 X |
| 5,193,368 | 3/1993 | Ling | 70/30 |
| 5,557,954 | 9/1996 | Ling | 70/69 X |

*Primary Examiner*—Lloyd A. Gall
*Attorney, Agent, or Firm*—Pro-Techtor International

[57] ABSTRACT

A luggage lock is composed of a lock body, a retainer engageable and disengageable with the lock body, and a retaining strap fastened at one end thereof with the retainer and at another end thereof with the body of a luggage to which the lock body is fastened. The lock body is provided with a locking and unlocking mechanism which works to enable the lock body to engage or disengage the retainer. The retaining strap is intended for use in securing the luggage to a fixed object such as a pole, guardrail, etc.

4 Claims, 9 Drawing Sheets (1)

LUGGAGE LOCK

FIELD OF THE INVENTION

The present invention relates generally to a luggage, and more particularly to a locking device of the luggage.

BACKGROUND OF THE INVENTION

As illustrated in FIG. 1, a prior art luggage lock is fastened with a strap of the luggage and is provided with a small key for unlocking the lock. The small key is rather susceptible to loss or misplacement.

As shown in FIG. 2, a combination lock of the prior art is intended for use in the luggage and is provided with an insertion rod 27 which is located in an insertion hole 103 of a lock body 10. A long strap 30 is exerted on by an external force so as to cause a strap retainer 20 to be pulled uprightly. As the strap retainer 20 exerts a horizontal lever force on a tongue 170 of the section hole 103 of the lock body 10, the tongue 170 is deformed easily to result in the disengagement of the strap retainer 20 and the lock body 10.

SUMMARY OF THE INVENTION

The primary objective of the present invention is to provide an improved locking device for a luggage. The improved locking device of the present invention is free from the defects of the prior art luggage locks described above.

In keeping with the principle of the present invention, the foregoing objective of the present invention is attained by a luggage lock, which is composed of a lock body, a retainer, and a retaining strap. The lock body comprises a locking and unlocking mechanism which works to enable the lock body to engage or disengage the retainer. The retaining strap is fastened with the retainer such that another end of the retaining strap is fastened securely with the luggage body to which the lock body is secured. The retaining strap is used to secure the luggage to a fixed object such as a pole, guardrail, etc.

DETAILED DESCRIPTION OF THE EMBODIMENTS

Figure 1:
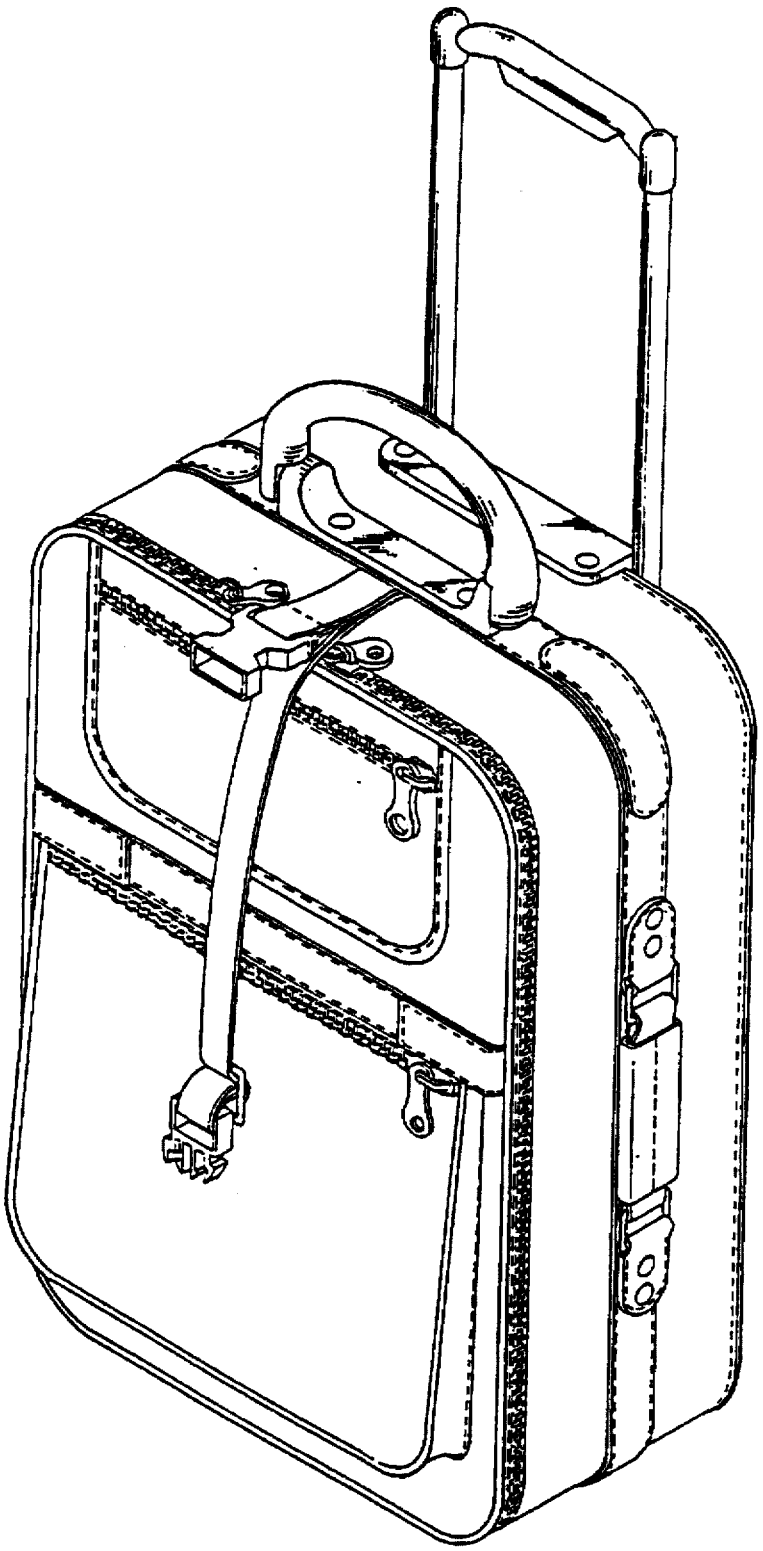
PRIOR ART FIG. 1
FIG. 1 shows a perspective view of a prior art luggage lock.
Figure 2:
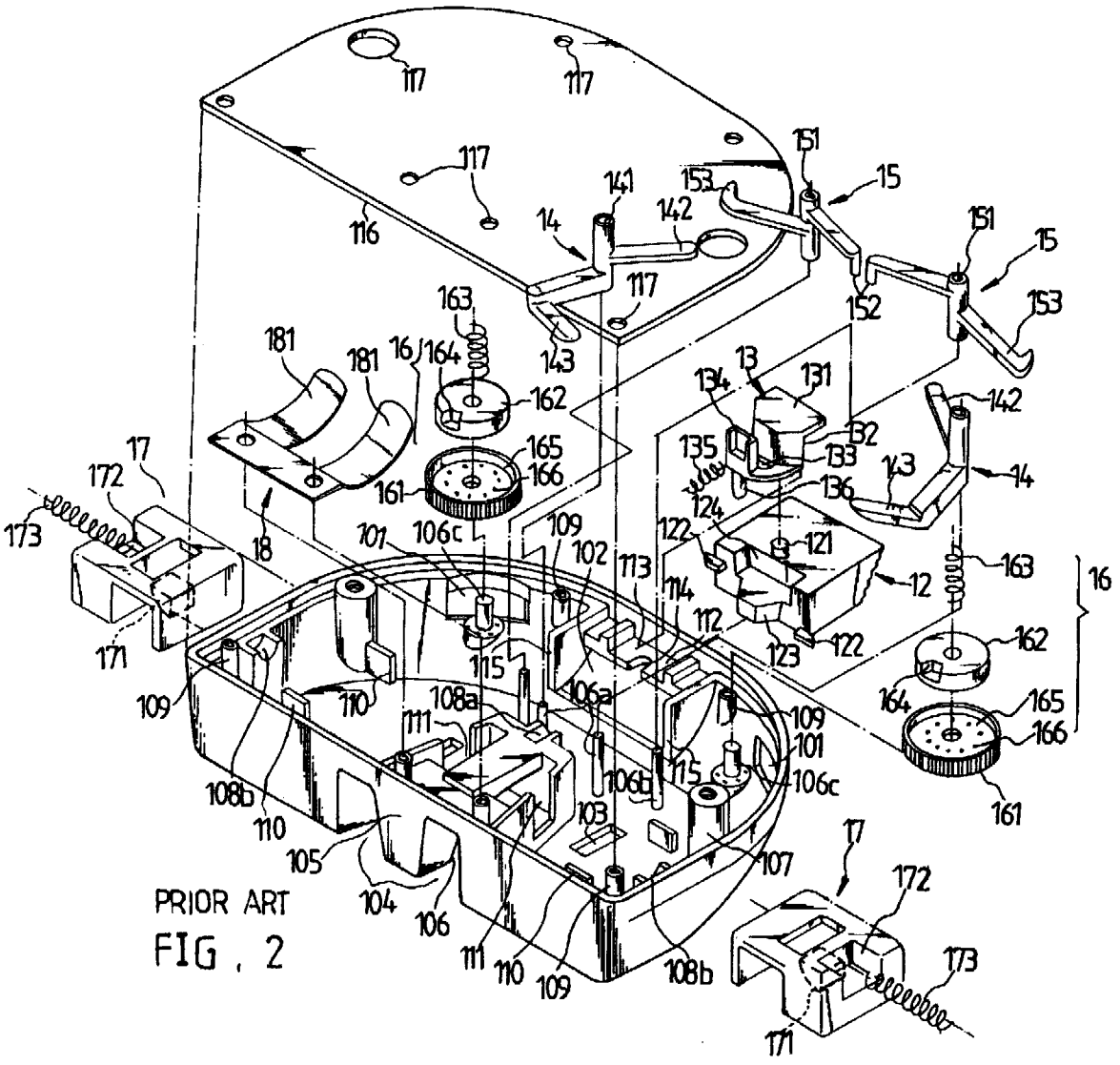
PRIOR ART FIG. 2
FIG. 2 shows an exploded view of a prior art combination lock intended for use in a luggage.
Figure 3:
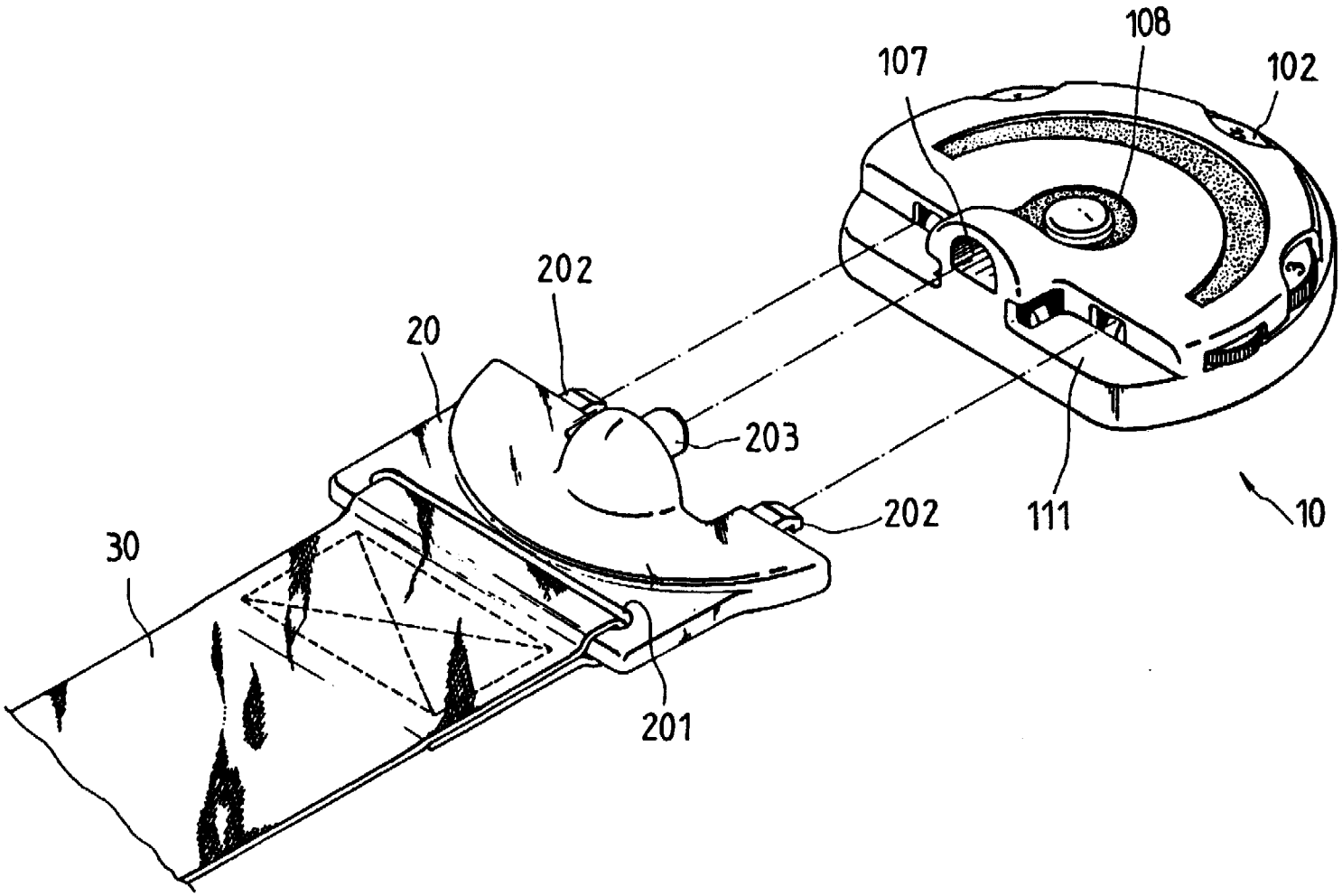
FIG. 3 shows an exploded view of a luggage lock of a first preferred embodiment of the present invention.
Figure 4:
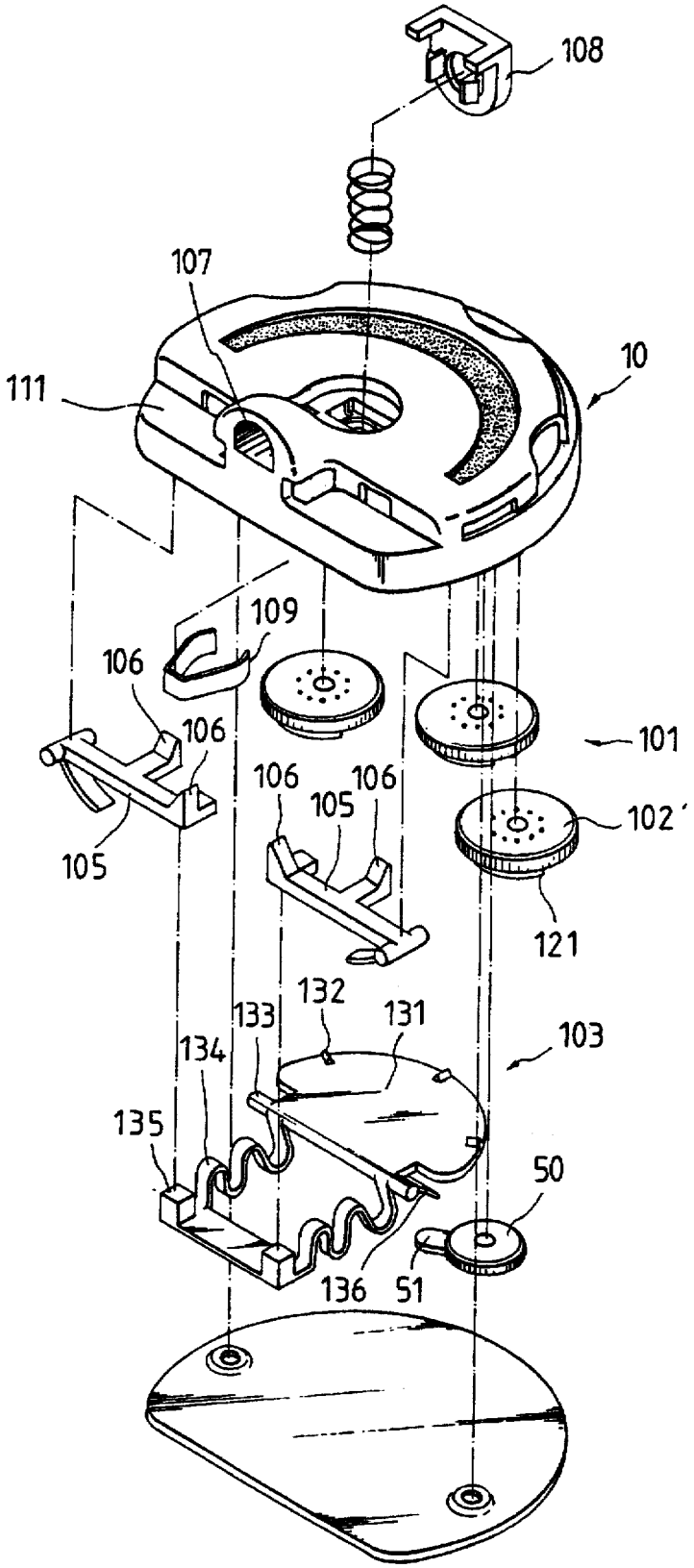
FIG. 4 shows another exploded view of the luggage lock of the first preferred embodiment of the present invention.

As shown in FIGS. 3–6, a lock of the first preferred embodiment of the present invention is intended for use in conjunction with a luggage and is composed mainly of a lock body 10, a retainer 20, and a retaining strap 30. The retaining strap 30 is fastened at one end thereof with the body of a luggage and at another end thereof with the retainer 20 which is engageable and disengageable with the lock body 10. The lock body 10 is provided therein with a locking and unlocking mechanism.

The lock body 10 is provided with a dial set 101 having a numbered wheel 102 capable of controlling a braking disk 103. The braking disk 103 has an arcuate portion 131 provided with a plurality of braking ribs 132 which are arranged at interval along the margin of the arcuate portion 131. The braking disk 103 further has a support rod 133 from which a corrugated elastic portion 134 is extended such that the elastic portion 134 is fastened at another end thereof with a stopping block 135. The support rod 133 is provided with a press piece 136 fastened therewith such that the press piece 136 is located between the elastic portion 134 and the arcuate portion 131. As the braking disk 103 is caused to swivel on the support rod 133, the stopping block 135 is extracted or retracted so as to cause two braking rods 105 to swing or not to swing. The braking rods 105 are provided respectively with a tongue 106 capable of engaging a pull chain 40, a pull ring 41 and the retainer 20. The lock body 10 is provided with a through hole 107, a press switch 108, and an elastic member 109 located between the two braking rods 105. As the tongue 106 is disengaged with the pull ring 41, the pull ring 41 can be forced out by the elastic member 109 such that the pull ring 41 slides out along a smooth surface 111.

The retainer 20 of a platelike construction is provided in one side thereof with a fastening slot 201 for fastening the retaining strap 30. The retainer 20 is further provided with two retaining projections 202 and one engagement projection 203 is located between the two retaining projection 202. The retaining projections 202 and the engagement projection are located at different levels and are opposite in location to the fastening slot 201.

Figure 5:
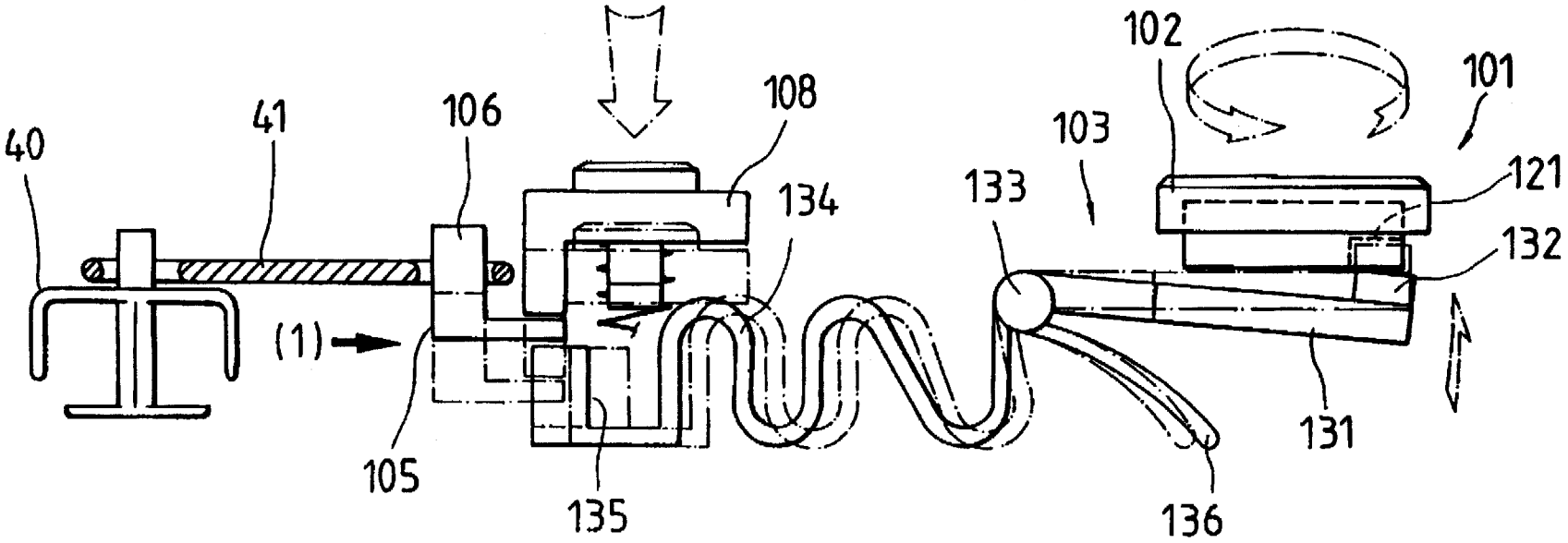
FIG. 5 shows a schematic view of the present invention at work.
Figure 6:
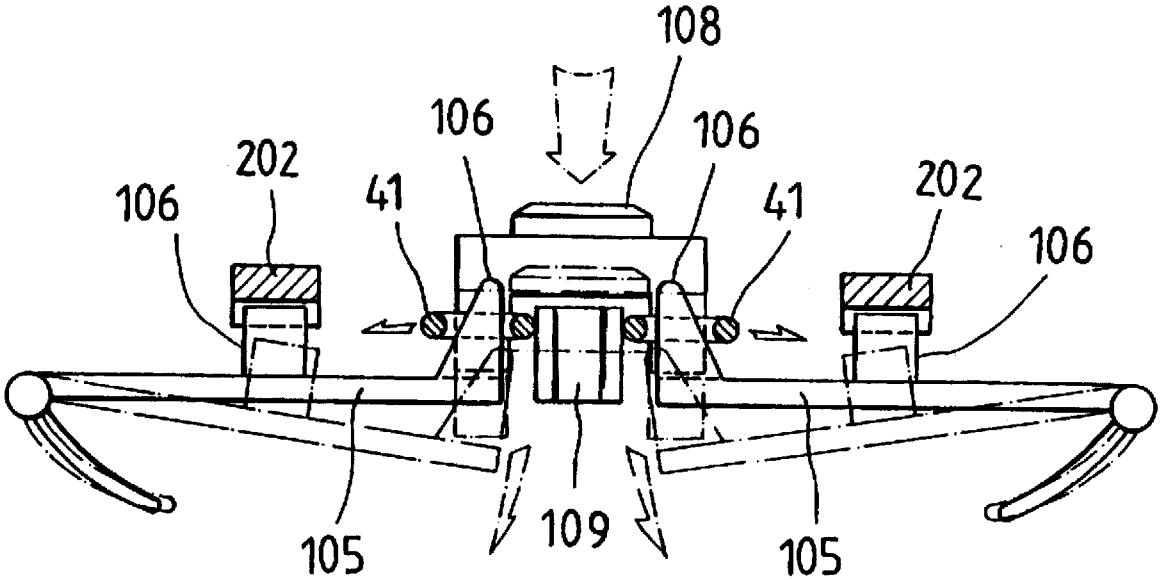
FIG. 6 is a side schematic view of the present invention as shown in FIG. 5.
Figure 7:
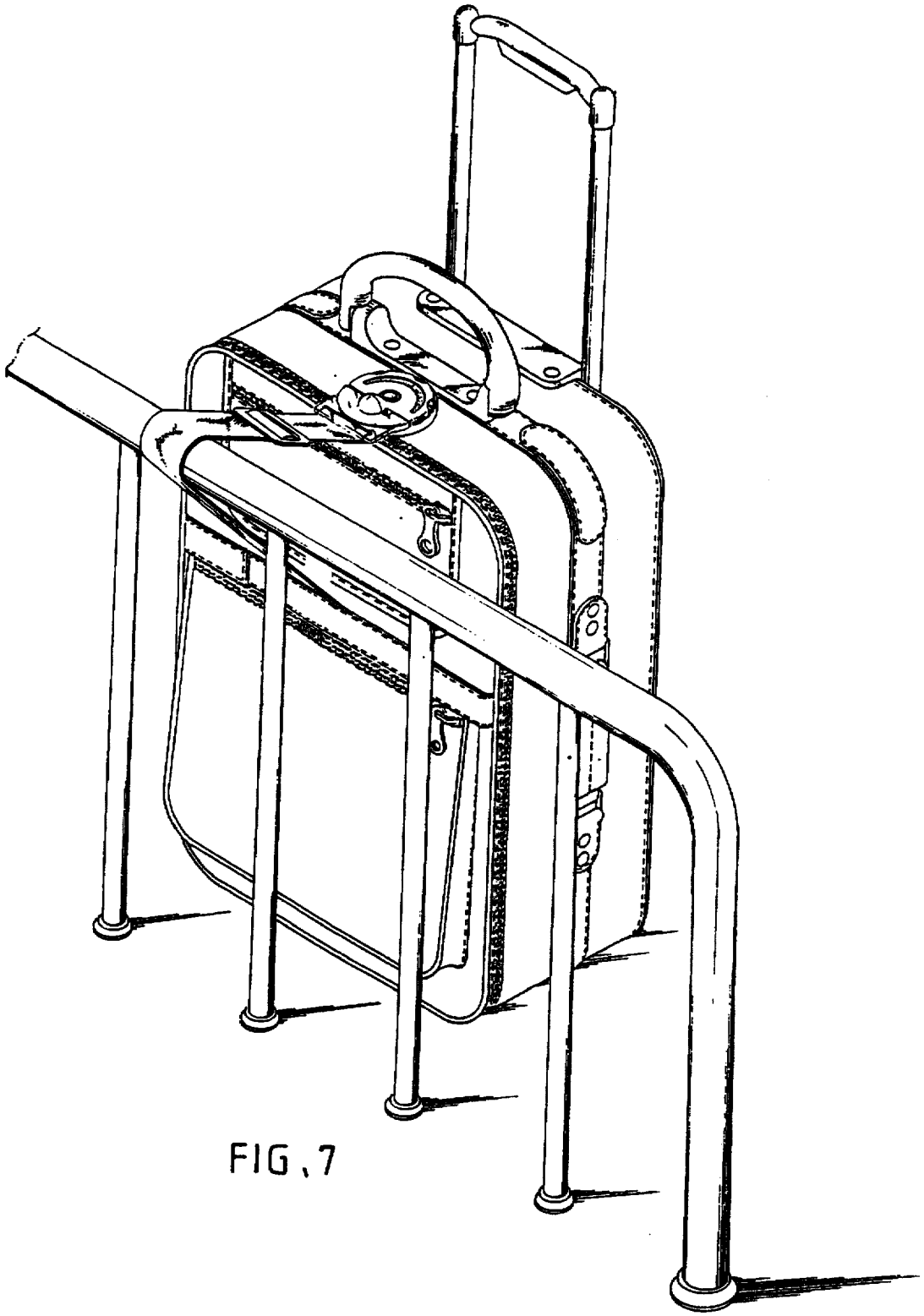
FIG. 7 shows a schematic view of the present invention at work along with a luggage to which the lock of the present invention is secured.

As the numbered wheel 102 is rotated such that the braking rib 132 becomes disengaged with one of the cuts 121 of the numbered wheel 102, the arcuate portion 131 is caused to tilt so as to actuate the elastic portion 134 in such a manner that the stopping block 135 is caused to extract and retract horizontally. As the stopping block 135 engages the braking rod 105, the pull ring 41 is fastened securely in view of the fact that the braking rod 105 is no long capable of swinging downwards. When the numbered wheel 102 is turned such that the correct number is shown, the cut 121 is aligned with the braking rib 132 of the arcuate portion 131. As a result, the tilted arcuate portion 131 is caused by the elastic force of the elastic portion 134 and the press piece 136 to regain its horizontal position, thereby forcing the braking rib 132 to become engaged with the cut 121. In the meantime, the stopping block 135 is disengaged with the braking rod 105 so as to enable the pull ring 41 to become disengaged with the braking rod 105. When the braking rod 105 is under pressure, the stopping block 135 is unable to extend to the underside of the braking rod 105. On the other hand, when the braking rod 105 is relieved of the pressure exerting thereon, the stopping block 135 is forced by the elastic force of the elastic portion to engage the braking rod 105, as illustrated in FIGS. 5 and 6. As the stopping block 135 is disengaged with the braking rod 105, the braking rod 105 can be caused to swivel by pressing the press switch 108. As a result, the pull ring 41 is not longer interfered by the tongue 106. On the other hand, when the stopping block 135 is engaged with the braking rod 105, the braking rod 105 can not be caused to swivel by pressing the press switch 108. As a result, the pull ring 41 is confined by the tongue 106. The lock body 10 of the present invention is therefore not vulnerable to being tampered with by an unauthorized person. Similarly, the retainer 20 of the present invention can not be easily tampered with.

Figure 8:
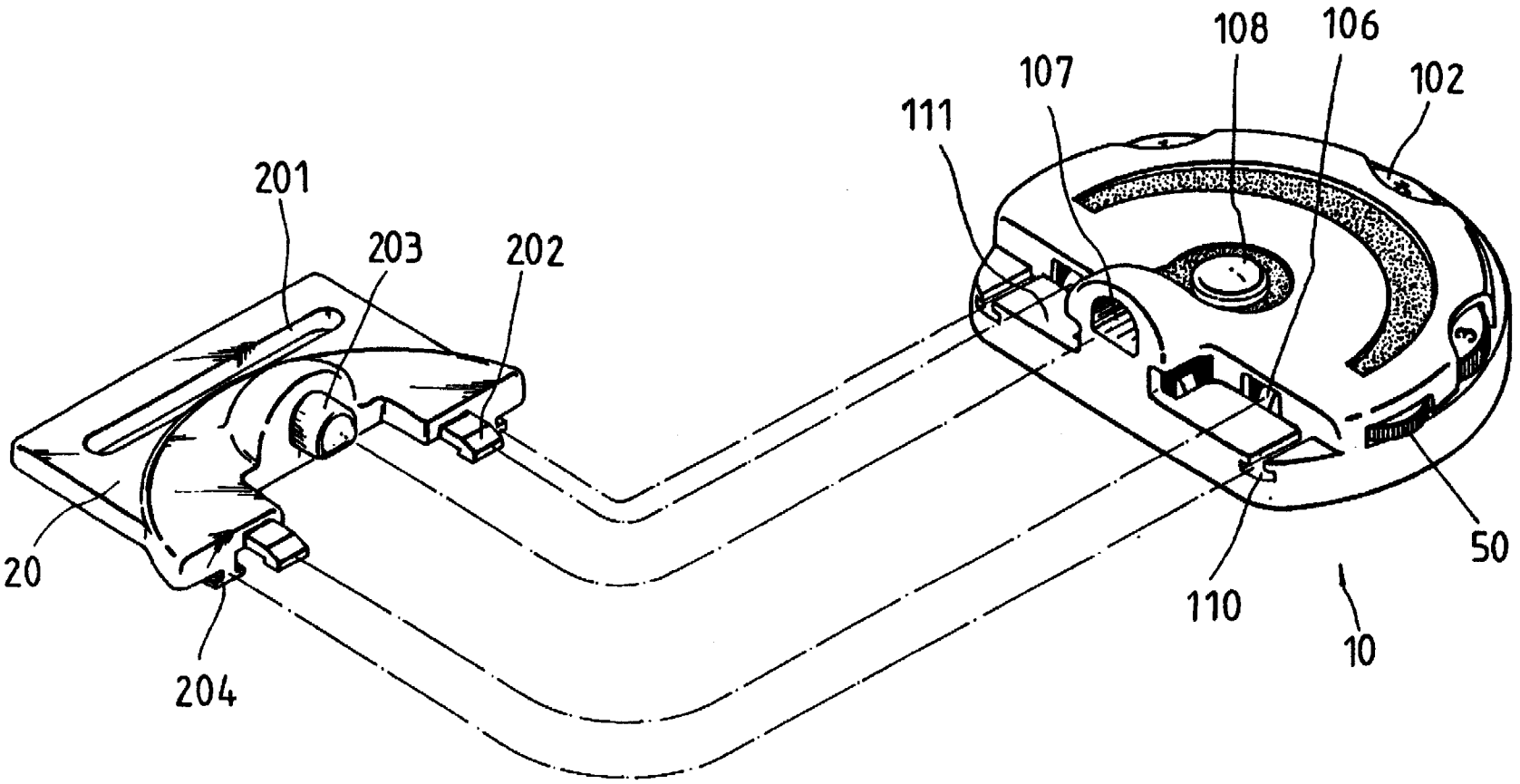
FIG. 8 shows an exploded view of a luggage lock of a second preferred embodiment of the present invention.

As shown in FIG. 8, the lock body 10 of the second preferred embodiment of the present invention is provided with two mortises 110 being the retainer 20, which is in turn provided with two tenons 204 adjoining the retaining projections 202 and engageable with the mortises 110 of the lock body 10. As a result, the lock body 10 and the retainer 20 of the second preferred embodiment of the present invention can be fastened together easily and securely.

Figure 9:
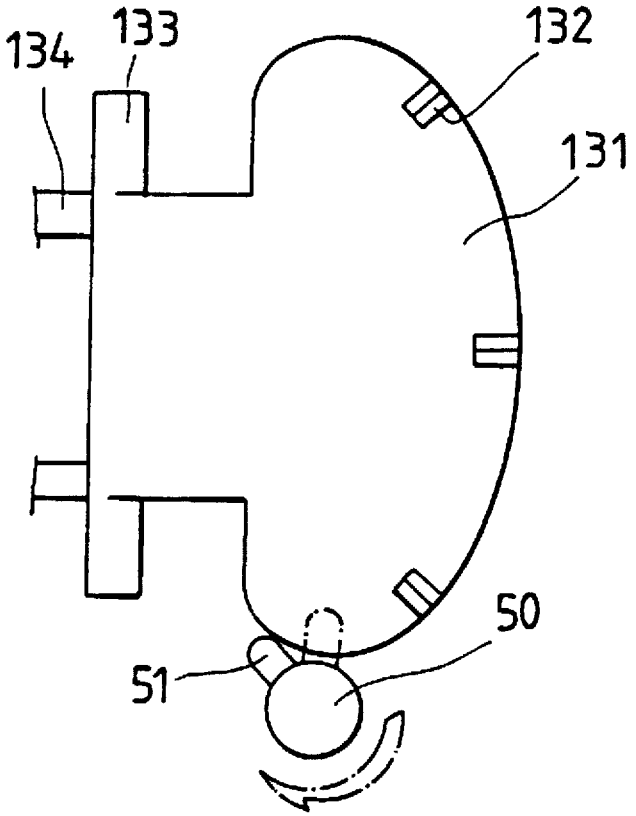
FIG. 9 shows a partial schematic view of a third preferred embodiment of the present invention.

Now referring to FIG. 9, the third preferred embodiment of the present invention is provided with a disklike stopping piece 50 contiguous to the arcuate portion 131 of the braking disk 103. The stopping piece 50 has a stopping block 51 projecting therefrom. As the numbered wheel 102 is set at a correct position which is indicated by a correct number, the braking rib 132 of the arcuate portion 131 is aligned with the cut 121. The stopping piece 50 can be rotated such that the stopping block 51 urges the arcuate portion 131, which is therefore unable to swivel so as to facilitate the resetting of a correct number or letter to work the mechanism that opens the lock.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A luggage lock comprising a lock body fastened with the body of a luggage, a retainer engageable and disengageable with said lock body, and a retaining strap fastened at one end thereof with the body of the luggage and at another end thereof with said retainer;

wherein said lock body is provided with a dial set having a numbered wheel capable of controlling a braking disk contained in said lock body, said braking disk having an arcuate portion provided with a plurality of braking ribs which are arranged at intervals along a fringe of said arcuate portion, said braking disk further having a support rod from which an elastic portion of a corrugated construction is extended in such a manner that said elastic portion is fastened with stopping blocks, said support rod being provided with a press piece fastened therewith such that said press piece is located between said elastic portion and said arcuate portion, said lock body further provided with two braking rods having a tongue capable of engaging a pull ring and said retainer, said two braking rods being provided therebetween with an elastic member capable of forcing said pull ring to move at such time when a tongue is disengaged from said pull ring, said lock body still further provided with a through hole and a press switch;

wherein said retainer is provided in one side thereof with a fastening slot for fastening one end of said retaining strap, said retainer further provided with two retaining projections and one engagement projection located between said two retaining projections, with said retaining projections and said engagement projection being located at different levels such that said retaining projections and said engagement projection are opposite in location to said fastening slot;

wherein said numbered wheel can be rotated such that one of said braking ribs of said arcuate portion becomes disengaged with one of indentations of said numbered wheel, thereby enabling said arcuate portion to be tilted so as to actuate said elastic portion of said braking disk to cause said stopping blocks of said braking disk to extract to engage said braking rods;

wherein when said numbered wheel is turned such that a correct number or letter is shown, one of said indentations of said numbered wheel is engaged with one of said braking ribs of said arcuate portion while said stopping blocks of said braking disk are disengaged from said braking rods so as to enable said pull ring to become disengaged from said braking rods, thereby enabling said braking rods to be caused to swivel by said press switch.

2. The luggage lock as defined in claim 1, wherein said lock body is provided with a plurality of mortises facing said retainer; and wherein said retainer is provided with a plurality of tenons engageable and disengageable with said mortises of said lock body.

3. The luggage lock as defined in claim 1, wherein said braking disk is provided with a stopping piece contiguous to said arcuate portion of said braking disk such that said stopping piece can be rotated to disable said arcuate portion at such time when said numbered wheel is set at a correct number or letter.

4. The luggage lock as defined in claim 3, wherein said stopping piece has a projection capable of disabling said arcuate portion of said braking disk at such time when said numbered wheel is set at a correct number or letter.

* * * * *